US007108783B2

(12) United States Patent
Glazik

(10) Patent No.: US 7,108,783 B2
(45) Date of Patent: Sep. 19, 2006

(54) DRAIN INLET

(75) Inventor: Gary B. Glazik, Paxton, IL (US)

(73) Assignee: Plastics Designs, Inc., Paxton, IL (US)

( * ) Notice: Subject to any disclaimer, the term of this patent is extended or adjusted under 35 U.S.C. 154(b) by 99 days.

(21) Appl. No.: 11/007,870

(22) Filed: Dec. 9, 2004

(65) Prior Publication Data

US 2006/0124519 A1 Jun. 15, 2006

(51) Int. Cl.
*E03F 5/06* (2006.01)

(52) U.S. Cl. ..... 210/163; 210/165; 210/170; 405/42

(58) Field of Classification Search ..... 210/163, 210/164, 165, 166, 170, 474, 476; 404/4, 404/5; 405/36, 42
See application file for complete search history.

(56) References Cited

U.S. PATENT DOCUMENTS

| | | | | |
|---|---|---|---|---|
| 1,456,759 | A * | 5/1923 | Booth | 210/170 |
| 1,457,637 | A * | 6/1923 | Sievers | 210/163 |
| 1,988,689 | A | 1/1935 | Sommerfeld | |
| 2,394,964 | A * | 2/1946 | Dick | 210/165 |
| 2,779,430 | A * | 1/1957 | Sisk | 210/165 |
| 3,246,582 | A * | 4/1966 | Wade et al. | 210/165 |
| 3,385,442 | A | 5/1968 | Swanson | |
| 4,663,036 | A | 5/1987 | Strobl, Jr. et al. | |
| 6,077,423 | A * | 6/2000 | Roy et al. | 210/170 |
| 6,261,445 | B1 * | 7/2001 | Singleton | 210/163 |
| 6,487,729 | B1 | 12/2002 | Delanzo | |
| 6,537,448 | B1 * | 3/2003 | Houk | 210/164 |
| 2005/0103694 | A1 * | 5/2005 | Rost et al. | 210/164 |

* cited by examiner

*Primary Examiner*—Christopher Upton
(74) *Attorney, Agent, or Firm*—Cook, Alex, McFarron, Manzo, Cummings & Mehler, Ltd.

(57) ABSTRACT

A drain inlet is disclosed for draining of liquid from an area in which it has collected. The inlet includes a body having a chamber therein for receiving the liquid from the area and an opening at the bottom of the body for draining the liquid from the chamber. The body is formed by a plurality of side walls each of which has a lateral cross section which is greater than the next adjacent lower side wall which permits a substantial reduction in the height of the body. The bottom of the side walls is connected to the top of the next lower side wall by a laterally extending wall which has a plurality of elongated slotted openings so that the fluid to be drained flows upwardly through these openings, into the chamber and out of the chamber through the opening at the bottom of the body to drain the area. The total cross sectional area of the openings in the walls through which the liquid flows is at least as great and preferably substantially greater than the cross sectional area through the opening at the bottom of the body which results in a substantial reduction in clogging of the openings by debris which may be present in the liquid being drained.

18 Claims, 2 Drawing Sheets

DRAIN INLET

BACKGROUND AND SUMMARY OF THE INVENTION

The present invention is directed to a drain inlet for draining a fluid from an area.

It is frequently desirable to drain fluids, such as standing water from areas in which it accumulates for example during wet weather in the spring or during periods of flood. For example, it is desirable to drain the water from low spots or terraces in agricultural fields to improve the crops and/or the soil when drained.

In the past, such drainage has been accomplished by way of drain tile which is buried beneath the surface of the soil and upstanding inlets which are spaced periodically along the length of the tile and which open above the soil surface and into the area where the water has accumulated to drain the area through the buried drain tile. In such systems some form of grate or screen is usually positioned at the opening to the upstanding drain tile inlet in order to prevent debris which may be in the water from flowing through the inlet and into the drain tile where it can rapidly clog the drain tile and prevent further drainage.

Various screen or grate devices have been employed in the past for this purpose. However, even if not plugged by debris, such prior screening devices generally reduce the flow volume of the water being drained at any given time from the potential flow volume which could be drained without the screen or grate.

In order to overcome this reduction in volume problem, in one prior drain inlet a cylindrical generally constant diameter upstanding pipe is positioned on the drain tile inlet. Such pipe has holes of approximately three quarters to one inch in diameter in bands around the pipe, and also may have a wire cage on the top to let water into the pipe where it can be transported to the buried drain tile. In order to provide a sufficient number of drain holes in the pipe to produce a total cross sectional area of drain holes which is at least as large as the cross sectional area of the pipe and drain tile inlet to maximize the flow volume through the pipe, the cylindrical pipe must extend four to five feet above the soil level. And, because each of the holes is relatively small and because the holes extend radially through the wall of the pipe, the flow rate through each of the holes is relatively high. This results in debris in the water which is to be drained to be drawn to and cover the holes due to the suction produced by the high flow rate through the holes. Moreover, the efficiency of such relatively tall pipe drain inlets is further diminished as the water level drops in the area being drained, because the water level will drop below the drain holes in the upper part of the pipe and, therefore, those holes will no longer function to provide drainage. Another disadvantage of these relatively tall prior pipe drain inlets is that they must be avoided during seeding and harvesting and it is generally necessary to seed and harvest around them because seeders and harvester combines cannot be elevated to a sufficient height during seeding and harvest to be able to pass over the relatively tall drain pipes.

The drain inlet of the present invention overcomes these several disadvantages of the last mentioned prior cylindrical upstanding drain pipe inlets. In the present invention water to be drained from an area flows upwardly into the drain inlet of the present invention through a plurality of elongated slots in laterally extending walls which separate adjacent side walls of the body of the drain inlet. The total cross sectional area of the slots is at least as great and preferably greatly exceeds the cross sectional area of the discharge from the drain inlet of the invention. This insures that the water flow volume into the drain inlet of the present invention is at least as great as the flow volume which can be discharged from the drain inlet even if some of the openings might become non-functional for one reason or another. Also because of the large cross sectional area of the slots, the flow rate though the slots is substantially reduced, thereby minimizing the collection of debris at the slots and the clogging of the slots by such debris. Thus, less time and hassle is involved in wading out into ponds to clean debris out of the openings than was needed with the relatively small holes of the prior drain inlets which was a nuisance and unpleasant task often done under very cold and wet conditions. Moreover, faster drainage of the standing water may be accomplished which is better for the crops and the soil. Also, because of the ability of the present invention to substantially maximize the flow volume through the drain inlet, it is no longer necessary as in the prior art that the drain inlet body stand as tall as it must to insure adequate flow volume. Therefore, the height of the drain inlet may be substantially shortened to a height which may be easily avoided by, for example combines during harvest most of which have heads which can be elevated three or more feet above the level of the ground. Still another advantage of the positioning of the openings in the drain inlet of the present invention in laterally extending walls is that the flow of the liquid from the pond into the drain inlet is upward, and any debris that may be trapped on the downwardly facing openings tends to fall away by gravity both during the draining procedure and after the pond has been drained. Thus, the openings of the drain inlet of the present invention are relatively self cleaning. Still another advantage of the present invention is that the amount of residue or debris that enters the buried drain tile is substantially reduced. This reduces the amount of BOD and nitrates in the water and the possibility of potential clogging and need to clean out or replace the buried drain tile.

In one principal aspect of the present invention, a drain inlet for draining a fluid from an area comprises a body having a chamber therein for receiving the fluid from the area and an opening adjacent the bottom of the body for draining the fluid from the chamber. At least two side walls form the body and are spaced from each other in the direction of the height of the body, the side wall closest to the opening adjacent the bottom of the body being smaller in lateral cross section than the lateral cross section of the next adjacent side wall which is farther from the opening. A wall extends laterally between the two side walls, and an opening is positioned in the laterally extending wall, whereby the fluid flows upwardly through the opening in the laterally extending wall and into the chamber, and out of the chamber through the opening adjacent the bottom of the body to drain the area of the fluid.

In another principal aspect of the present invention, a plurality of the openings are located in the laterally extending wall.

In still another principal aspect of the present invention, the total cross sectional area of the openings in the laterally extending wall is at least as great as the cross sectional area of the opening adjacent the bottom of the body.

In still another principal aspect of the present invention, the opening in the laterally extending wall is an elongate slot.

In still another principal aspect of the present invention, an upstanding member is positioned around the opening in the laterally extending wall.

In still another principal aspect of the present invention, the upstanding member is a flange.

In still another principal aspect of the present invention, a cover is positioned adjacent the uppermost of the side walls.

In still another principal aspect of the present invention, ribs are on the cover.

In still another principal aspect of the present invention, the cover is generally imperforate.

In still another principal aspect of the present invention, the cover has openings through which the fluid also flows into the chamber.

In still another principal aspect of the present invention, the drain inlet includes a high visibility component.

In still another principal aspect of the present invention, ribs are positioned on the side walls.

In still another principal aspect of the present invention, the laterally extending wall extends between the top of the side wall adjacent the opening adjacent the bottom of the body and the bottom of the next adjacent side wall which is farther from the opening.

In still another principal aspect of the present invention, the drain inlet comprises a plurality of the laterally extending walls and side walls, whereby the body increases in cross section from the bottom to the top thereof, each laterally extending wall extends laterally between the top of one side wall and the bottom of the next upwardly adjacent side wall. A plurality of openings are located in each laterally extending wall, the openings are elongated slots and, the total cross sectional area of the slots is at least as great as the cross sectional area of the opening adjacent the bottom of the body. A cover is located adjacent the uppermost of the side walls.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENTS

Figure 1:
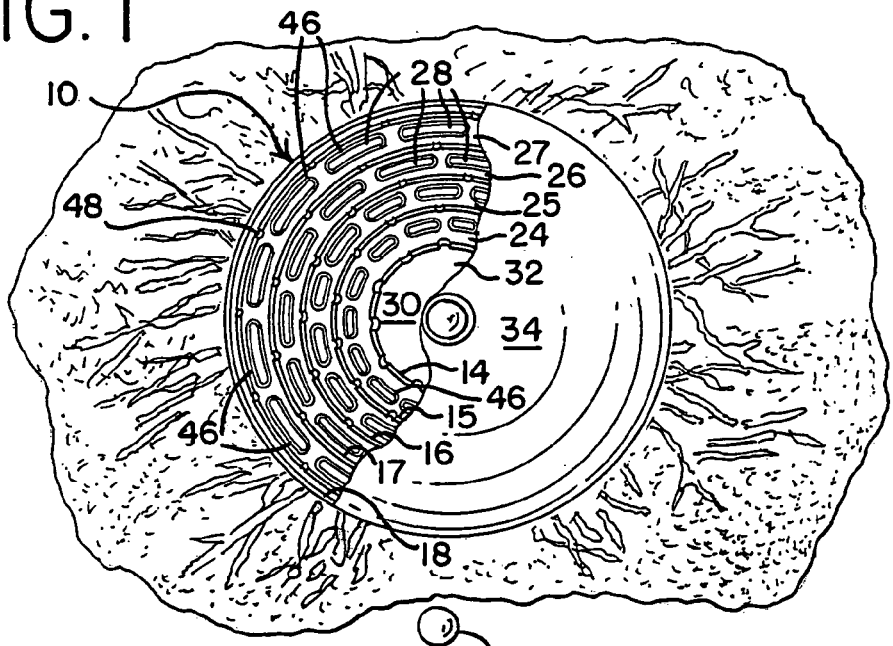
FIG. 1 is a partially broken plan view of a preferred embodiment of drain inlet of the present invention positioned in a pond which is being drained.
Figure 2:
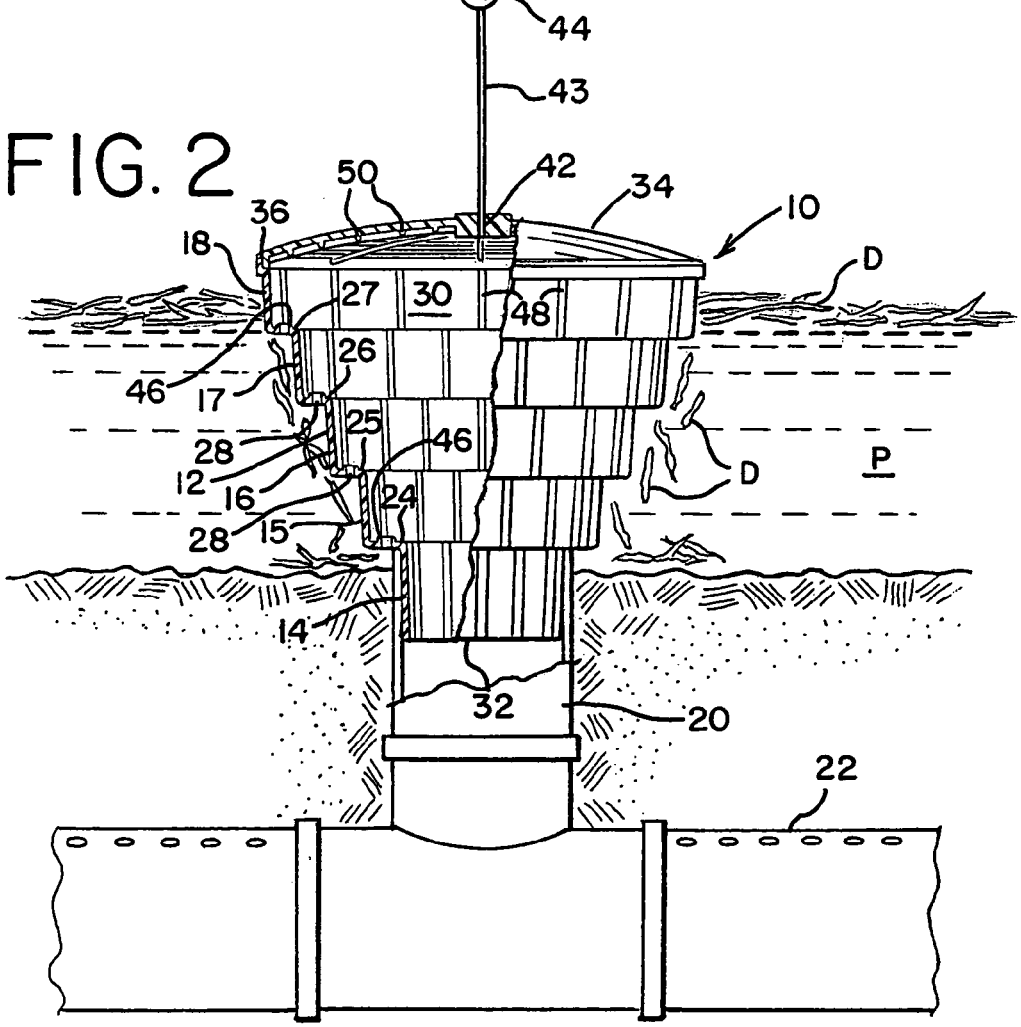
FIG. 2 is a cross sectioned partially broken elevation view of the drain inlet substantially as shown in FIG. 1 and showing it positioned in the upstanding inlet to a drain tile beneath the pond to be drained.

With particular reference to FIGS. 1 and 2, a preferred embodiment of drain inlet 10 of the present invention comprises a generally upstanding body 12 formed of a plurality of generally upwardly extending side walls 14, 15, 16, 17 and 18. The bottommost side wall 14 is preferably tapered to be slightly smaller toward its bottom to enable it to be press fit into the opening in the upstanding inlet 20 of a drain tile 22 which is installed beneath pond P to be drained, as best seen in FIG. 2. The drain tile 22 may either be unperforated or perforated as shown in FIG. 2. The remaining side walls 15–18 also extend upward either vertically or at a slight angle to the vertical.

The construction of the body 12 is completed by generally horizontal steps which are formed by walls 24, 25, 26 and 27 which extend laterally between the top of the next lower adjacent side wall and the bottom of the next upper adjacent side wall. Although as shown in the drawing the walls 24–27 extend generally horizontally, they may extend laterally but at somewhat of an angle between their respective side walls. In any event it will be seen that the body 12 of the drain inlet of the present invention is not of constant diameter or cross section over its height, but instead increases in cross section in a stepped fashion from bottom to top.

Each of the laterally extending walls 24–27 also preferably includes a substantially large number of elongate slotted openings 28 which open in a generally vertical direction between the pond P which is to be drained and an interior chamber 30 of the body 12 of the drain inlet 10. Accordingly, as previously discussed, the total area of the elongate slotted openings 28 is at least as great and preferably substantially greater than the cross sectional area of the bottom side wall 14 which forms the discharge opening 32 from the chamber 30 into the upstanding inlet 20 and drain tile 22. Because of this the flow rate through each of the slotted openings 28 is quite low thus minimizing the possibility of clogging of the openings by debris D which may be in the water to be drained. However, the large total area of the openings maximizes the flow volume into the chamber 30 even if some of the openings 28 may be inadvertently clogged, because the potential total flow volume through the openings 20 is much greater than through the discharge opening 32 where the total area of the openings is substantially greater than through the discharge opening 32. Clogging of the openings 28 is also minimized by the vertical flow through the openings 28 which maximize the possibility that debris may simply fall by gravity from the openings at the low flow rates. Moreover, maximum efficiency of the drain inlet of the invention is achieved by the ability to shorten the height of the drain inlet by increasing its cross section from bottom to top while achieving maximum flow volume because more of the openings will still remain submerged even after the pond has been substantially drained in contrast to the drain inlets of the prior art which must stand tall in the pond.

Although the drain inlet of the present invention may widely vary in size depending on its use, a typical drain inlet for the draining of an agricultural field may be about 15 inches tall, 18 inches in diameter at the top, and 6 inches in diameter at the bottom side wall 14 where it fits into the upstanding drain tile inlet 20.

The top of the body 12 of the drain inlet 10 is preferably closed by a generally imperforate cover 34 as seen in FIGS. 1 and 2. The cover 34 is attached in a suitable manner to the top of the uppermost side wall 18, such as by a snap or press fit 36. The cover 34 is also preferably somewhat domed to prevent the retention of debris D on the cover.

Figure 3:
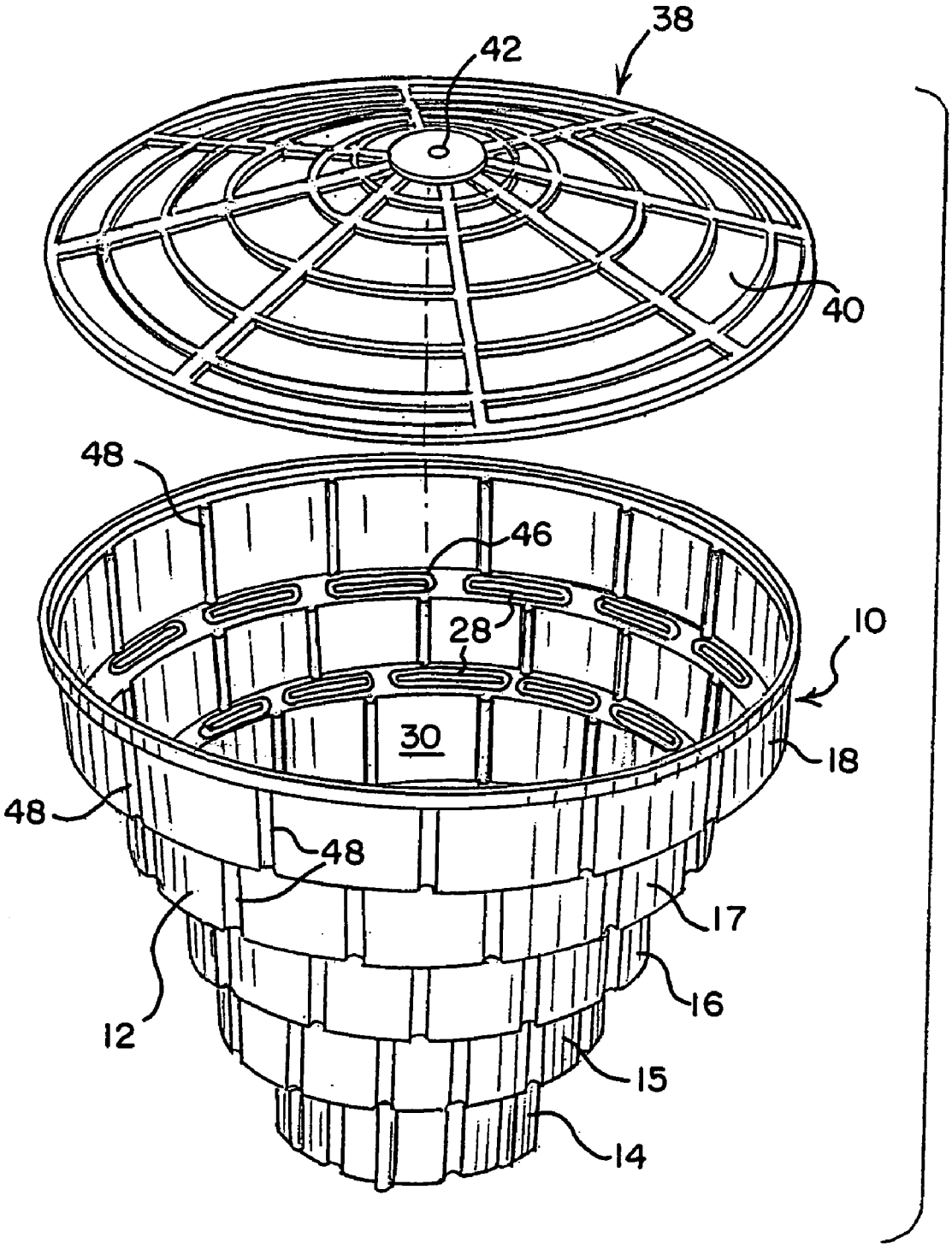
FIG. 3 is an exploded perspective view of a preferred embodiment of the drain inlet of the present invention and having a cover with openings therethough to permit additional flow of water into the drain inlet of the present invention.

In an alternative embodiment as shown in FIG. 3, the cover 34 may be replaced by a ribbed grate-like cap 38 having openings 40 therethrough which permit the passage of water into the chamber 30 from the top of the drain inlet, but which restrains large debris D from passing into the chamber 30. Although not shown, the cap may be formed of a finer mesh or screen if desired, rather than the ribbed grate which is shown. It will also be appreciated that the drain inlet 10 as sold may include both the cover 34 and the cap 38 to permit selective use by the ultimate user.

The cover 34, grate cap 38 and/or body 12 may be treated or coated to have a bright, highly colored or highly reflective surface so that the drain inlet 10 is highly visible to the operator of agricultural machinery in the field, such as a harvester combine operator. In addition, or in the alternative, a receptacle 42 may be formed in the center of the cover 34 and/or grate cap 38 to receive the end of an elongate rod 43 having a reflector or highly colored indicator 44 at the top as seen in FIG. 2.

The body 12 of the drain inlet and/or its cover 34 or grate cap 38 is preferably thermo-formed, injection molded or rota-molded of a plastic. However, one or more of those components could be formed from concrete, steel, aluminum or other materials if desired.

Where the drain inlet 10 is formed of plastic or of any material in which additional strength reinforcement may be desired, the walls 24–27 adjacent the elongate slotted openings 28 may be reinforced by an upstanding flange 46 which surrounds the openings 28 and extends upwardly around the perimeter of the openings. In addition, the side walls 24–28 may also be formed with vertically extending ribs and/or grooves 48 which are spaced from each other around the perimeter of the side walls. The raised ribs may extend inwardly of the body 12 toward the chamber 30 with the grooves on the exterior of the body or vice-versa, or adjacent ribs/grooves 48 may alternate to extend inwardly with the next adjacent rib/groove extending outwardly as seen on the lower most side wall 14.

The cover 34 may also be formed with ribs 50 as seen in FIG. 2 to reinforce the cover.

Although the drain inlet 10 has been shown as being circular in shape and in the form of a generally inverted stepped cone, it will be appreciated that the drain inlet may be of other cross sectional geometric shapes, such as square or rectangular in cross section.

It will also be appreciated that although the drain inlet 10 has been described in the drainage of ponds in agricultural or other natural environments, the drain inlet of the present invention could be employed in other applications, e.g. floor and sink drains, parking lot drains, storm sewer drains or fluid storage tanks or the like in which a fluid is being removed from a body of fluid where there is a need to minimize potential clogging from solids. The solids may include a wide range of waste, such as human, animal and vegetative materials, sludge, and other debris and waste materials.

It will also be understood that the preferred embodiments of the present invention which have been described are merely illustrative of the principles of the present invention. Numerous modifications may be made by those skilled in the art without departing from the true spirit and scope of the invention.

I claim:

1. A drain inlet for draining a fluid from an area, the inlet comprising:

a body having a chamber therein for receiving the fluid from the area and an opening adjacent the bottom of the body for draining the fluid from the chamber;

at least two side walls forming said body and spaced from each other in the direction of the height of said body, the side wall closest to said opening adjacent the bottom of the body being smaller in lateral cross section than the lateral cross section of the next adjacent side wall which is farther from said opening;

a wall extending laterally between said two side walls; and an opening in said laterally extending wall; whereby the fluid flows upwardly through said opening in said laterally extending wall and into said chamber, and out of said chamber through said opening adjacent the bottom of the body to drain the area of the fluid.

2. The drain inlet of claim 1, comprising a plurality of said openings in said laterally extending wall.

3. The drain inlet of claim 2, wherein the total cross sectional area of said openings in said laterally extending wall is at least as great as the cross sectional area of said opening adjacent the bottom of the body.

4. The drain inlet of claim 1, wherein said opening in said laterally extending wall is an elongate slot.

5. The drain inlet of claim 1, including an upstanding member around said opening in said laterally extending wall.

6. The drain inlet of claim 5, wherein said upstanding member is a flange.

7. The drain inlet of claim 1, including a cover adjacent the uppermost of said side walls.

8. The drain inlet of claim 7, including ribs on said cover.

9. The drain inlet of claim 7, wherein the cover is generally imperforate.

10. The drain inlet of claim 7, wherein the cover has openings through which the fluid also flows into said chamber.

11. The drain inlet of claim 1, including a high visibility component on said drain inlet.

12. The drain inlet of claim 1, including ribs on said side walls.

13. The drain inlet of claim 1, wherein said laterally extending wall extends between the top of the side wall adjacent the opening adjacent the bottom of the body and the bottom of the next adjacent side wall which is farther from said opening.

14. The drain inlet of claim 1, comprising a plurality of said laterally extending walls and side walls, whereby said body increases in cross section from the bottom to the top thereof, each said laterally extending wall extends laterally between the top of one side wall and the bottom of the next upwardly adjacent side wall, a plurality of said openings in each said laterally extending wall, said openings being elongated slots, the total cross sectional area of said slots being at least as great as the cross sectional area of said opening adjacent the bottom of the body, and a cover adjacent the uppermost of said side walls.

15. The drain inlet of claim 14, including an upstanding flange around said slots.

16. The drain inlet of claim 14, including ribs on said cover.

17. The drain inlet of claim 14, including a high visibility component on said drain inlet.

18. The drain inlet of claim 14, including ribs on said side walls.

* * * * *